US005300724A

United States Patent [19]

Medovich

[11] Patent Number: 5,300,724

[45] Date of Patent: Apr. 5, 1994

[54] REAL TIME PROGRAMMABLE, TIME VARIANT SYNTHESIZER

[76] Inventor: Mark Medovich, 4875 Edsal Dr., Lyndhurst, Ohio 44124

[21] Appl. No.: 991,472

[22] Filed: Dec. 15, 1992

Related U.S. Application Data

[63] Continuation of Ser. No. 742,504, Jul. 5, 1991, abandoned, which is a continuation of Ser. No. 390,715, Jul. 28, 1989, abandoned.

[51] Int. Cl.[5] ..... G10H 1/057; G10H 7/02

[52] U.S. Cl. ..... 84/604; 84/627

[58] Field of Search ..... 84/600–608, 84/621–633

[56] References Cited

U.S. PATENT DOCUMENTS

| | | | |
|---|---|---|---|
| 4,082,027 | 4/1978 | Hiyoshi et al. . | |
| 4,175,464 | 11/1979 | Deutsch . | |
| 4,217,802 | 8/1980 | Deforeit | 84/604 |
| 4,223,583 | 9/1980 | Deutsch . | |
| 4,387,622 | 6/1983 | Deutsch . | |
| 4,549,459 | 10/1985 | Deutsch . | |
| 4,643,066 | 2/1987 | Oya . | |
| 4,643,067 | 2/1987 | Deutsch . | |
| 4,656,912 | 4/1987 | Deutsch . | |
| 4,677,889 | 7/1987 | Deutsch . | |
| 4,697,490 | 10/1987 | Deutsch . | |
| 4,833,963 | 5/1989 | Hayden et al. | 84/627 |
| 4,909,118 | 3/1990 | Stevenson | 84/622 |
| 4,953,437 | 9/1990 | Starkey | 84/603 |

*Primary Examiner*—Stanley J. Witkowski

*Attorney, Agent, or Firm*—Renner, Otto, Boisselle & Sklar

[57] ABSTRACT

A method for modelling time variant signals and multiple tone generating apparatus for a real time controllable, time variant waveform synthesizer. Speech or musical tone generation is accomplished by storing a DSQ (Demodulated Segment Quantization) codebook representation of a time variant signal. A DSQ codebook is a parametric representation of a time variant signal, wherein a signal's parameters are a time variant amplitude data sequence, a time variant pitch (advance/delay operator) data sequence, and a data sequence corresponding to a set of invariant waveshapes and their corresponding duration values. A signal is reconstructed by concatenating periodic segments of finite duration and, scaling its amplitude via a time variant amplitude data sequence and altering pitch or harmonic content via a time variant pitch data sequence. A plurality of unique DSQ codebooks and tone generators are assigned to a plurality of key actuations for multi-timbral operation.

4 Claims, 15 Drawing Sheets

A
0
time
ID = 34
ID = 311
ID = 1429
40 milliseconds
20 ms.
30 ms.
Advance/Delay Operator
+ 2
+ 1
Advance/Delay Operator Duration
0
40
Waveshape ID Numbers
34
311
1429
Waveshape ID Number Duration Parameters
0
40
60
Amplitude Envelope Coefficient
.125
.250
.375
.5
Amplitude Envelope Coefficient Duration
0
5
10
15

REAL TIME PROGRAMMABLE, TIME VARIANT SYNTHESIZER

This application is a continuation of application Ser. No. 07/742,504 filed on Jul. 5, 1991 and now abandoned which is a contination of application Ser. No. 07/390,715 filed on Jul. 28, 1989 and now abandoned.

TECHNICAL FIELD OF THE INVENTION

This invention relates generally to a musical sound or speech synthesizer, and more particularly, to improvements in quasi-periodic signal modelling processes, time variant waveform synthesis, and real time control of time variant waveshapes in such a synthesizer.

BACKGROUND OF THE INVENTION

Musical sounds such as those produced by acoustic instruments are known to be generally, quasi-periodic. When a musical sound is analyzed by traditional means such as Fourier Analysis, a time variant spectrum associated with the sound is typically observed. To faithfully reproduce musical sound as heard by the ear, a synthesis method must therefore address the problem of producing time variant waveforms.

One existing method for synthesizing time variant waveforms is known as subtractive synthesis. Subtractive synthesis filters a steady state signal via a digital or analog filter whose frequency response can be changed in real time. Another time variant synthesis method, commonly referred to as FM synthesis, frequency modulates a signal and sums that signal with a steady state signal.

FM synthesis takes advantage of the time variant nature of the spectrum produced by frequency modulation. A third commonly employed method, harmonic interpolation synthesis, produces a time variant waveform by computing a spectrum from an existing spectrum via an interpolation algorithm, and a time dependent variable.

Music synthesizers employing these prior art methods cannot, however, accurately reproduce the entire range of acoustic musical instrument sounds. Further they offer only very limited or no means for real time modification of the time variant parameters which control the time variant nature of a sound. In the case of subtractive synthesis and FM synthesis, a sound is synthesized by trial and error until it is judged by the listener to be a reasonable facsimile of the desired acoustic instrument timbre. Harmonic interpolation synthesis implements a Fourier analysis approach which is cumbersome. Since a full audio bandwidth signal may have up to 1000 time varying spectral components, it would be extremely difficult to develop any meaningful time dependent interpolation algorithm for every "harmonic" in a musical spectrum.

Another technique used for acoustic musical reproduction is referred to as sampling. This technique simply digitizes an analog signal and stores it in memory. To accurately reproduce the entire range of a musical instrument of interest, it is necessary to store a digital representation for every note in the musical instrument's range. Since this practice requires an excessive amount of memory, most sampling instruments store a reduced number of waveform representations. Playing a note which has a different frequency or duration than the original sampled waveform stored in a sampling instrument's memory, produces a distorted version of the original signal. The distortion or error increases as a function of the difference in pitch between the played note and the originally sampled note. Distortion occurs when a sampled note's recorded duration differs from the it's playback duration. Typically, sampling instruments extend a sample's duration (during playback) by "looping" through a portion of the original sample for an extended period of time. This action changes the time variant nature of the originally sampled instrument, hence distorting the original signal.

It would be desirable to provide a process for analyzing the time variant nature of quasi-periodic signals, and an apparatus for synthesizing signals in real time from parameters derived from that process.

SUMMARY OF THE INVENTION

It is an object of the present invention to provide an analytical model for time variant signals which facilitates data reduction in quasi-periodic signals, and the preservation of the time dependant variances of a time variant spectrum when pitch is transposed.

It is another object of the invention to provide an apparatus which can synthesize speech or musical tones in real time.

It is a further object of the invention to provide a means for transposing a signal's pitch in real time while preserving the time dependent variances in a time variant spectrum.

It is a further object of this invention to provide a means for imparting signal variances of one time variant signal onto the variant characteristics of another time variant signal, in real time.

It is still a further object of this invention to provide a means for controlling or changing all time variant characteristics of a time variant signal, in real time.

DETAILED DESCRIPTION OF THE INVENTION

Figure 1:
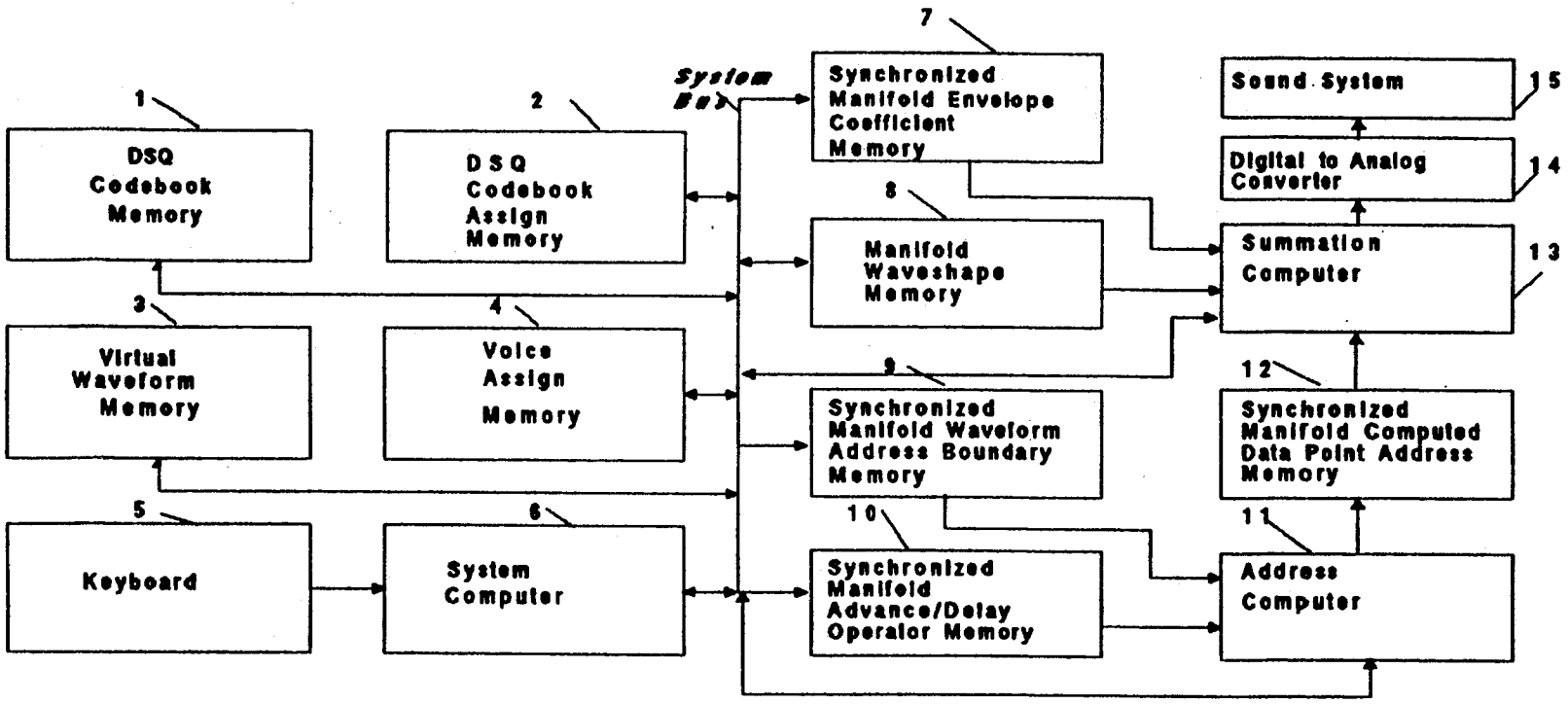
FIG. 1 is a schematic block diagram of the preferred physical embodiment of a musical instrument according to this invention.

Referring now to the several figures in which like reference numberals depict like items, and initially to FIG. 1, there is shown a schematic block diagram of a real-time programmable time variant waveform synthesizer. In accordance witht he invention, the synthesizer employs a method of Demodulated Segment Quantization (DSQ), the principles of which are discussed below.

Generally, the discussion showns that the amplitude envvelope and pitch variance can be separated from a digitized time variant waveform. The amplitude and pitch information can then be demodualted to provide a signal having both a constant amplitude and constant pitch. This signal is of a much smaller spectral density than the complete time-variant signal and can thus be processed and encoded in real tiem usign a relatively small amount of dynamic memory. What this evidences is that a time variant waveform may be snythesized from a catalogue of stored waveshpaes, duration, and advance and delay values. Thus, realistic speech or musical sounds of almost any musical instrument can be reproduced faithfully in real-time in accordance witht he invention.

Specifically, an arbitrary digital signal of finite duration can be represented by a sequence $$\S X_n+ \text{ for } n=\S 0,1,2,\ldots,N+.$$

Typically, a signal $\S X_n+$ has finite duration N*t (i.e.,N multiplied by t), where N=total number of samples in the sequence $t=1/f_s$ where, $f_s$=sampling frequency.

For constant $f_s$, $\S X_n+$ is considered to be shift invariant, and if $$\S X_n+ = \S X_{n+p}+ \text{ is true for some p,}$$

then $\S X_n+$ represents one period of a periodic digital signal. A single cycle digital signal stored in memory (ROM or RAM) can be sequentially accessed at a constant rate to produce a periodic waveshape, as is well established in the prior art.

However, consider the sequence $\S C_n+$ generated by $$C_n=B+(C_{n-1}+d)MOD[(E+1)-B] \text{ for } n=\S 1,2,\ldots,N+, \text{ and } B> \qquad \text{EQ1.}$$

E, where $$C_o=B.$$

EQ1 generates a sequence of numbers with values bounded by the limits B and E, where B represents the lower limit and E the upper limit. EQ 1 can be implemented as an equation which generates the addresses of data points stored in memory. The lower boundary or address of a waveshape lookup table is given by B, while the upper address is equal to E. Therefore, if $C_n$ is periodically computed and used as the address for a lookup table $X_{Cn}$ which stores $\S X_n+$, then for every $C_n$ there exists an $XC_n$, and for every $\S C_n+$ there exists an $\S X_{Cn}+$. Assuming EQ1 is computed every $1/f_s$, and d=1, the sequence $\S C_n+$ will be periodic with a period of $$T\{C_n\}=(1/f/_s)[((E+1)-B)/d]. \qquad \text{EQ2.}$$

Note that $T\{C_n\}$ of EQ2 can be decreased as d increases.

Suppose we have an equation of the form $$C_{ni}=B_i+(C_{(n-1)i}+d)MOD[(E_i+1)-B_i] \qquad \text{EQ3.}$$

for $\{n\}_i=\{1,2,\ldots,N_i\}$, $i=\{1,2,\ldots,I\}$, $B_i<E_i$, and $|E_i-B_i|$=constant, for all i, where $$C_{oi}=B_i$$

We may also write $$T_{\{n\}i}=(N_i)(1/f_s) \qquad \text{EQ3a.}$$

where $T_{\{n\}i}$ is the duration or period of the sequence $\{C_n\}_i$.

If the $T_{\{n\}i}$ is greater than $T_{\{Cn\}}$, then $$\{C_n\}\rightarrow\{X_{Cn}\} \text{and}$$

$$\{C_n\}_i\rightarrow\{X_{Cn}\}_i,$$

where

→is read as "gives rise to".

The significance of EQ3 is that if for each unique $(B_i,E_i)$ pair, there exists a unique $\{X_{Cn}\}_i$, and if the sequence {i} is time variant, then the sequence $\{\{X_{Cn}\}_i\}$ will be time variant with respect to {i}. (A digital sequence which gives rise to another unique digital sequence is commonly referred to as a digital filter.) Hence, if there exists some $$\{ID_i\} = \{B_i, E_i\} \text{ for } i=\{1,2,\ldots,I\} \text{ and } |Ei-Bi| = \text{constant for all } i, \qquad \text{EQ3b.}$$

and since there exists a unique $T_{\{n\}i}$ for every $ID_i$ we may write, $$\{ID_i, T_{\{n\}i}\}\rightarrow\{\{C_n\}_i\}\rightarrow\{\{X_{Cn}\}_i\}. \qquad \text{EQ4.}$$

EQ4 tells us that the vector, $(ID_i,T_{\{n\}i})$ gives rise to the sequence $\{X_{Cn}\}_i$, and that the sequence $(ID_i,T_{\{n\}i}\}$ gives rise to the sequence $\{\{X_{Cn}\}_i\}$. Further, there exists a unique spectrum $F[\{X_{Cn}\}_i]$, (which is the Fourier transform of $\{X_{Cn}\}_i$), associated with each unique vector $ID_i$. Hence, a time variant spectrum can be produced from a time variant sequence $\{ID_i,T_{\{n\}i}\}$, provided that $\{ID_i, T_{\{n\}i}\}$ contains at least 2 unique elements. Thus, EQ4 represents a time variant digital filter.

Since the $|E_i - B_i| = \text{constant}$ (for all i) restriction was placed upon EQ3, and since d of EQ3 is constant, $\{\{(X_{Cn}\}_i\}$ has constant frequency, $$f = 1/T_{\{Cn\}} \quad \text{EQ4a.}$$

$\{\{X_{Cn}\}_i\}$ can be frequency modulated if d of $EQ_3$ is time variant.

Hence, $$C_{nij} = B_i + (C_{(n-1)i} + d_j) MOD[(E_i + 1) - B_i)] \quad \text{EQ5.}$$

for $\{n\}_i = \{1,2,.,N_i\}$,
$i = \{1,2,.,I\}$,
$j = \{1,2,.,J\}$,
$B_i < E_i$, and $|E_i - B_i| = \text{constant}$, for all i, where $$C_{oi} = B_i$$

If $d_j$ changes more than once over the interval $T_{\{Cn\}}$, we may write $$\{\{C_{nj}\}_i\} \rightarrow \{\{X_{Cnj}\}_i\}. \quad \text{EQ6.}$$

EQ5 in combination with EQ4a tells us the frequency of the digital signal {XCn}i can vary without affecting T{n}i which is a very important result. The significance being that the time dependent harmonic relationship between spectra in a time variant signal can be preserved when pitch is shifted.

A completely general expression for a time variant signal may be written as, $$\S\S X_{Cnjk} +_i + = \S\S A_k(X_{Cnj}) +_i + \text{ for} \quad \text{EQ7.}$$

$k = \S\ 1,2,..,K^+$
$0 \leq A_k \leq 1$ where $A_k$ is an amplitude modulation sequence.

It is important to note that the time variant sequence given by EQ7 can be amplitude demodulated and frequency demodulated. By demodulating EQ7 we can obtain the sequences $$\S A_k + \text{ for } k = \S 1,2,..,K+,$$

and $$/\S dj + \text{ for } j = \S 1,2,\ldots,J+.$$

If $\S A_k +$ and $\S d_j +$ are signals with frequency much less than the sampling frequency $f_s$ then it is advantageous to write $$\S A_k + \longleftrightarrow \S T_k + \text{ and} \quad \text{EQ8.}$$

$$\S d_j + \longleftrightarrow \S T_j +, \text{ where} \quad \text{EQ9.}$$

$$T_k = N_k(1/f_s) \text{ and}$$

$$T_j = N_j(1/f_s).$$

EQ8 and EQ9 are read as, for the sequence $\S A_k +$ there exists a sequence $\S T_k +$ and for the sequence $\S d_j +$ there exists a sequence $\S T_j +$ respectively. Further, that $T_k$ is a period over which $A_k$ is constant, and $T_j$ is a period over which $d_j$ is constant.

We may now define a DSQ codebook as the elements of the sequences $$\{V_i\} = \{ID_i, T_{\{n\}i}\}, \quad \text{EQ10a.}$$

$$\{f_j\} = \{d_j, T_j\}, \text{ and} \quad \text{EQ10b.}$$

$$\{e_k\} = \{A_k, T_k\}. \quad \text{EQ10c.}$$

EQ10a represents a time variant sequence wavetable address boundary sequence which when used as "input" to EQ3 gives rise to a time variant sequence.

Figure 14:
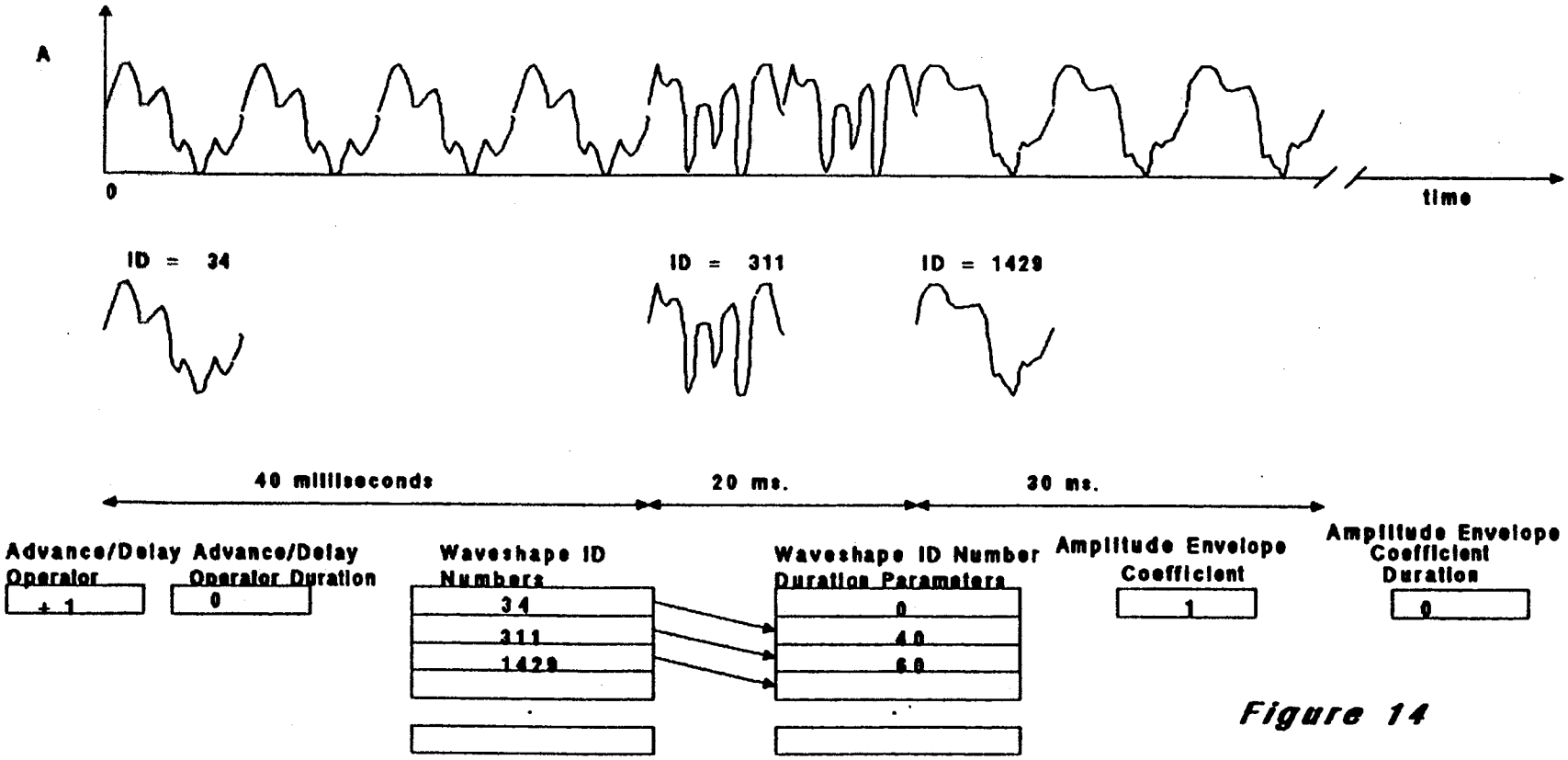
FIG. 14 is an illustration of an amplitude normalized frequency demodulated time variant waveshape.
Figure 15:
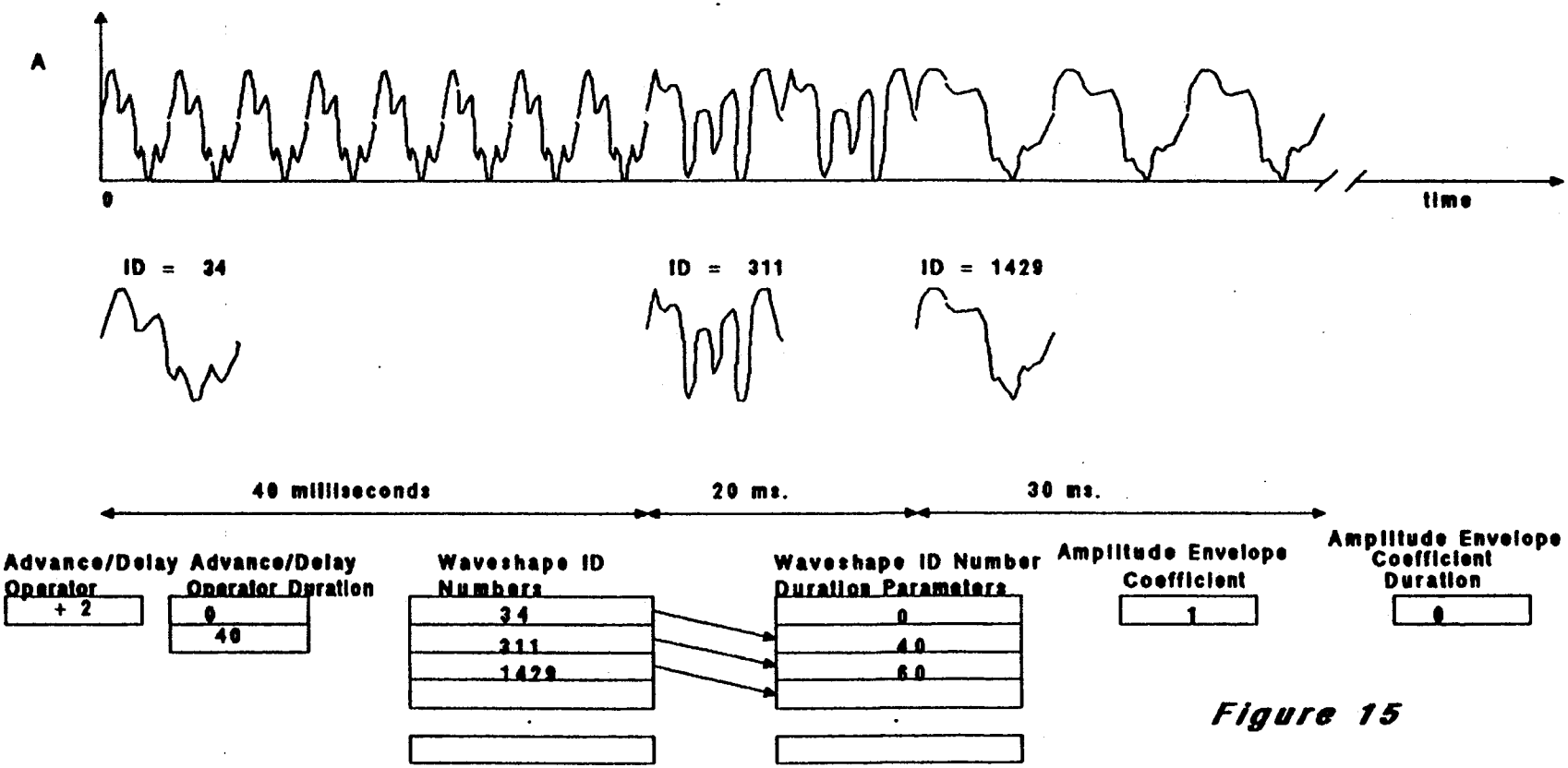
FIG. 15 is an illustration of a frequency modulated, amplitude normalized time variant waveshape; and, FIG. 16 is an illustration of an amplitude and frequency modulated time variant waveshape.
Figure 16:
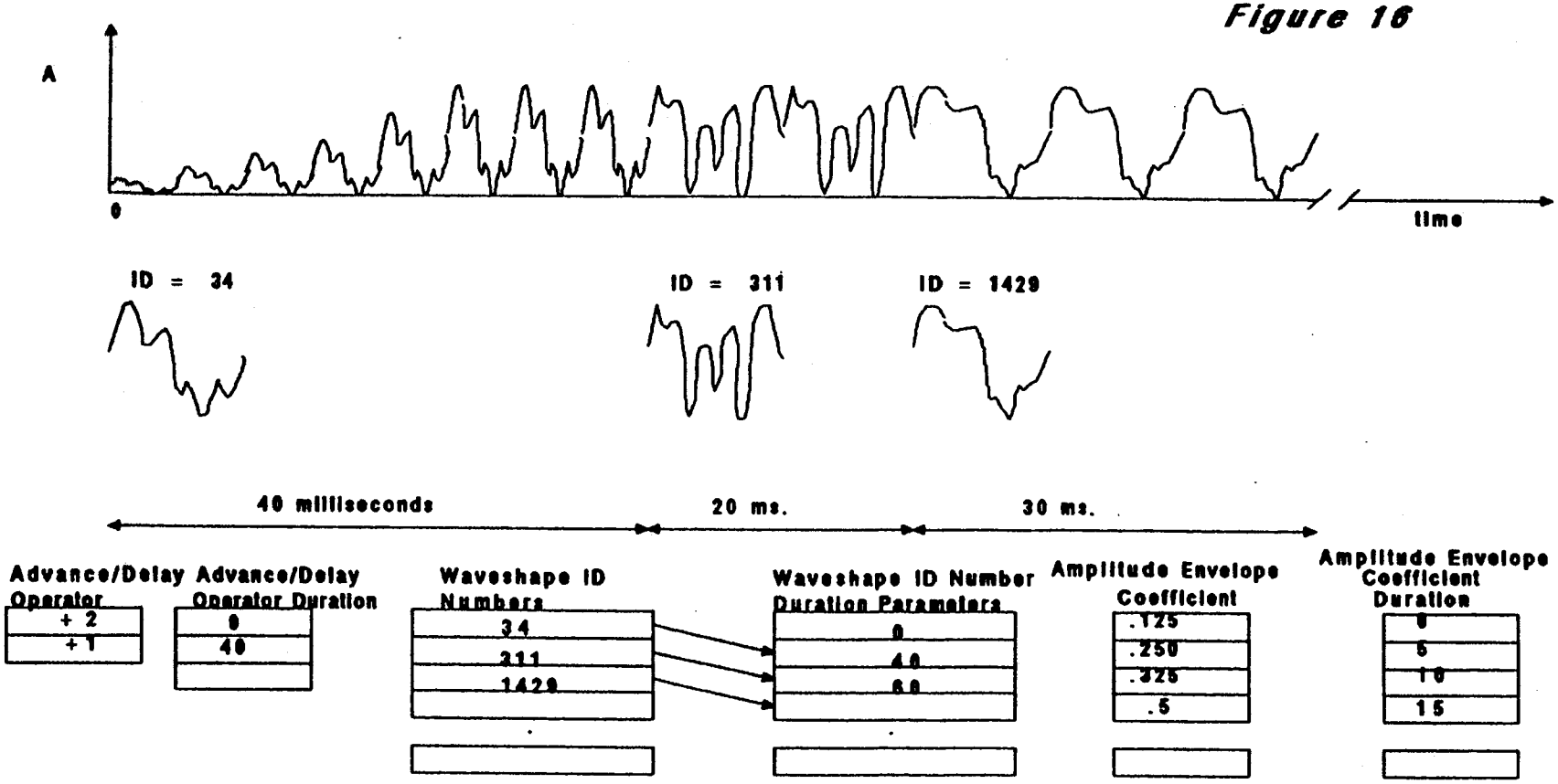

FIG. 14 illustrates $ID_0 = 34$ which indicates that there exists a $(B_0, E_0)$ which are the lower and upper address boundaries of the wavetable representing the waveshape labeled ID=34. Further, that $ID_0$ would be constant for a period of $T_{\{n\}0} = 40$ milliseconds. Thus, for FIG. 14 we would have the DSQ codebook $$V_0 = (34, 40 \text{ ms}),$$

$$V_1 = (311, 20 \text{ ms}),$$

$$V_2 = (1429, 30), \ldots$$

$$V_i = (ID_i, T_{\{n\}i}).$$

Since FIG. 14's frequency and amplitude are constant over time, the sequences $\{f_j\}$ of EQ10b and $\{e_k\}$ of EQ10c each contain only one element. That is, $f_0 = (d_0, T_0)$ for all time, and $e_0 = (A_0, T_0)$ for all time.

This process of demodulating amplitude and demodulating frequency of a time variant signal, then finding unique {XCn}i and their corresponding $T_{\{n\}i}$ of EQ4 is called DSQ.

The preferred practical embodiment of a synthesizer employing DSQ to reproduce time variant waveforms in real-time is illustrated generally in FIGS. 1-9.

Overview of Time Variant Waveform Generation

The System Computer 6 generates variant sequences of the form EQ3b, EQ8, and EQ9. The generated sequences which have the form of EQ3b and EQ9 are transferred to the Address Computer 11 via the Synchronized Manifold Waveform Boundary Memory 9, and the Synchronized Manifold Advance Delay Operator Memory 10, respectively. The Address Computer 11 computes $C_{nij}$ according to the equation given by EQ5 thereby generating the sequence given by EQ6 (i.e.,$\{\{(C_{nj}\}_i\}$. The sequence of the form $\{\{C_{nj}\}_i\}$ generated by the Address Computer 11, and sequence of the form of EQ8 (i.e. $\{A_k\}$) are transferred to the Summation Computer 13 via the Synchronized Manifold Computed Data Point Address Memory 12, and the Synchronized Manifold Envelope Coefficient Memory 7, respectively. The Summation Computer 13 uses each $C_{nij}$ as an address to fetch a waveshape data value stored in Manifold Waveshape Memory 8, then scales said data value by an amount proportional to $A_k$, thus producing a sequence of the form given by EQ7. The Summation Computer 13 sums a plurality of scaled data values during a computation cycle, then outputs the sum to the Digital to Analog Computer 14 whose analog output drives the input of a Sound System 15.

Key Assignment

Figure 9:
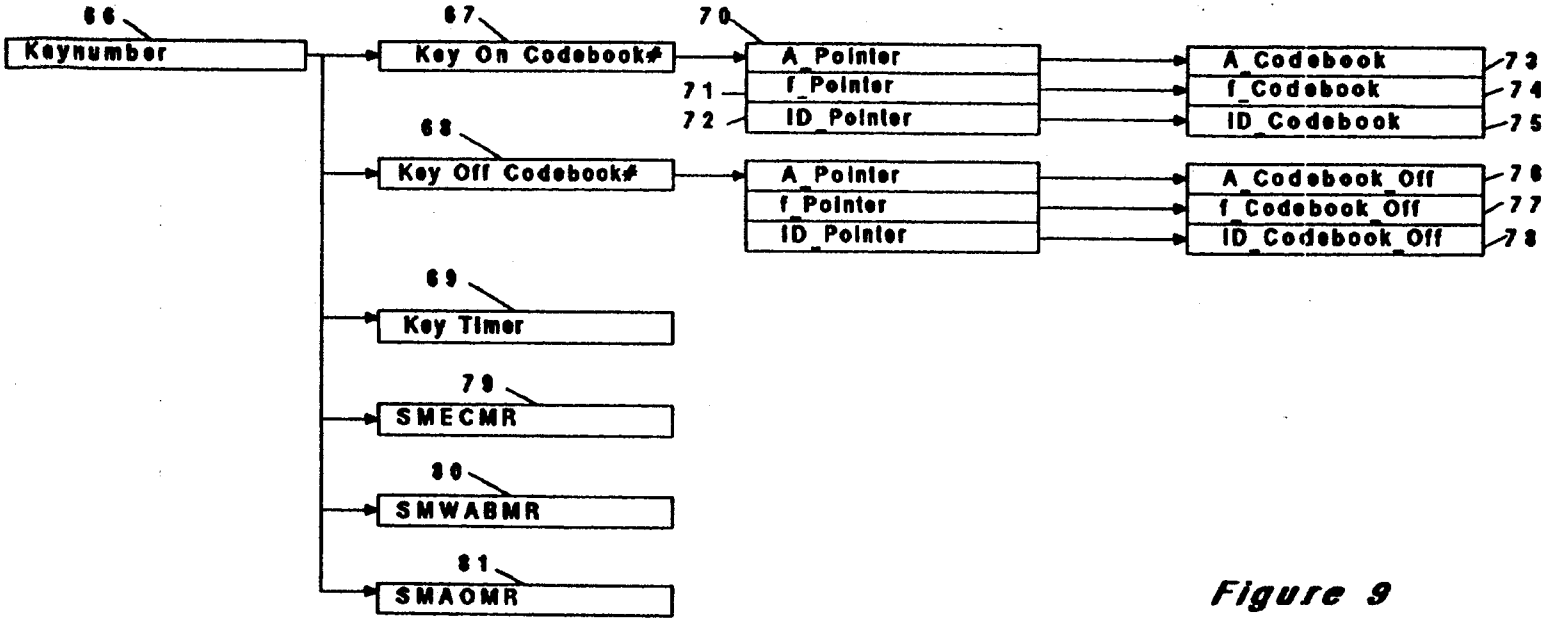
FIG. 9 is a chart illustrating the plurality of registers assigned to a key actuation with a given Keynumber.

The Keyboard 5 actuates a keyswitch and sends a serial data code to the System Computer's Serial Communication Interface 62. The Serial Communication Interface 62 receives the data code transmitted by Keyboard 5, and interrupts the CPU 61. The CPU 61 executes an Serial Communication Interface interrupt service routine which makes the register assignment as illustrated in FIG. 9, to memory registers in DSQ Codebook Assign Memory 2 and Voice Assign Memory 4. The Key Timer 69 is initialized to a value equal to zero, and an SMECMR 79 register is assigned to an available memory location in the Synchronized Manifold Envelope Coefficient Memory 7. Key and register assignment are performed under System Computer 6 program control. Methods of task and register assignment under software control are well known and common in the computer application programming and system programming art. After these tasks and assignments are performed, the Serial Communication Interface 62 interrupt service routine is terminated.

Time Variant Sequence Generation

Variant Amplitude Sequence $\{A_k\}$ Generation

DSQ codebooks of the form of EQ10a, EQ10b, and EQ10c, which represent models of musical instruments, are stored in DSQ Codebook Memory 1.

The time variant sequence given by EQ5 is generated by the System Computer 6 and the Address Computer 11. The System Computer's Timer 60 generates a periodic interrupt to the System Computer's CPU 61 which then executes the Timer interrupt service routine as illustrated in FIG. 13.

Figure 6:
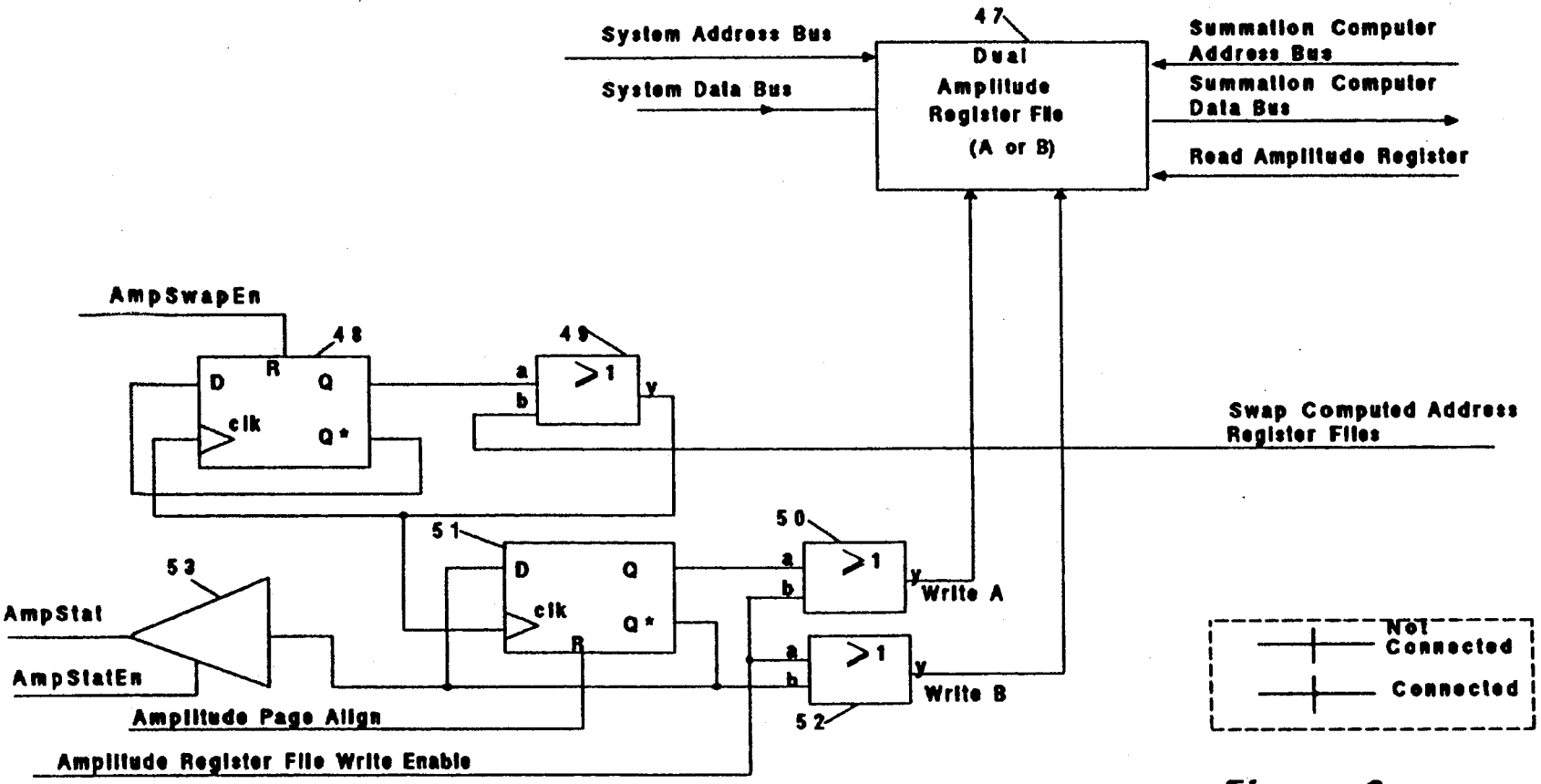
FIG. 6 is a schematic block diagram of the Synchronized Manifold Envelope Coefficient Memory.
Figure 7:
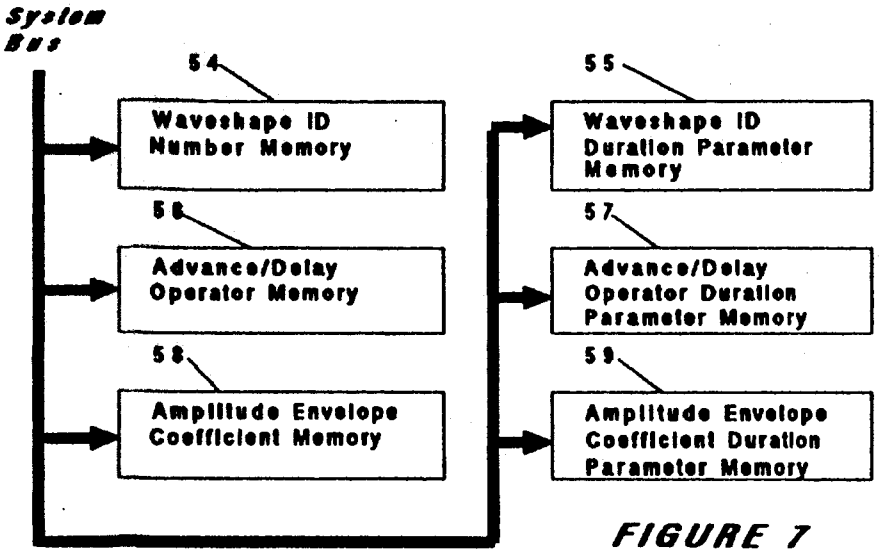
FIG. 7 is a schematic block diagram of the DSQ Codebook Memory.
Figure 8:
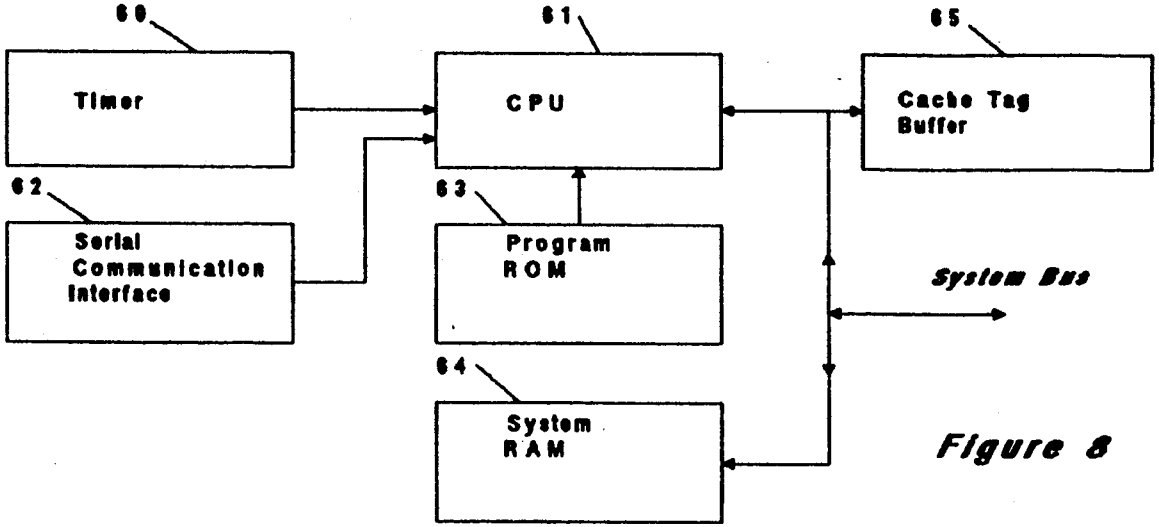
FIG. 8 is a schematic block diagram of the System Computer.
Figure 10:
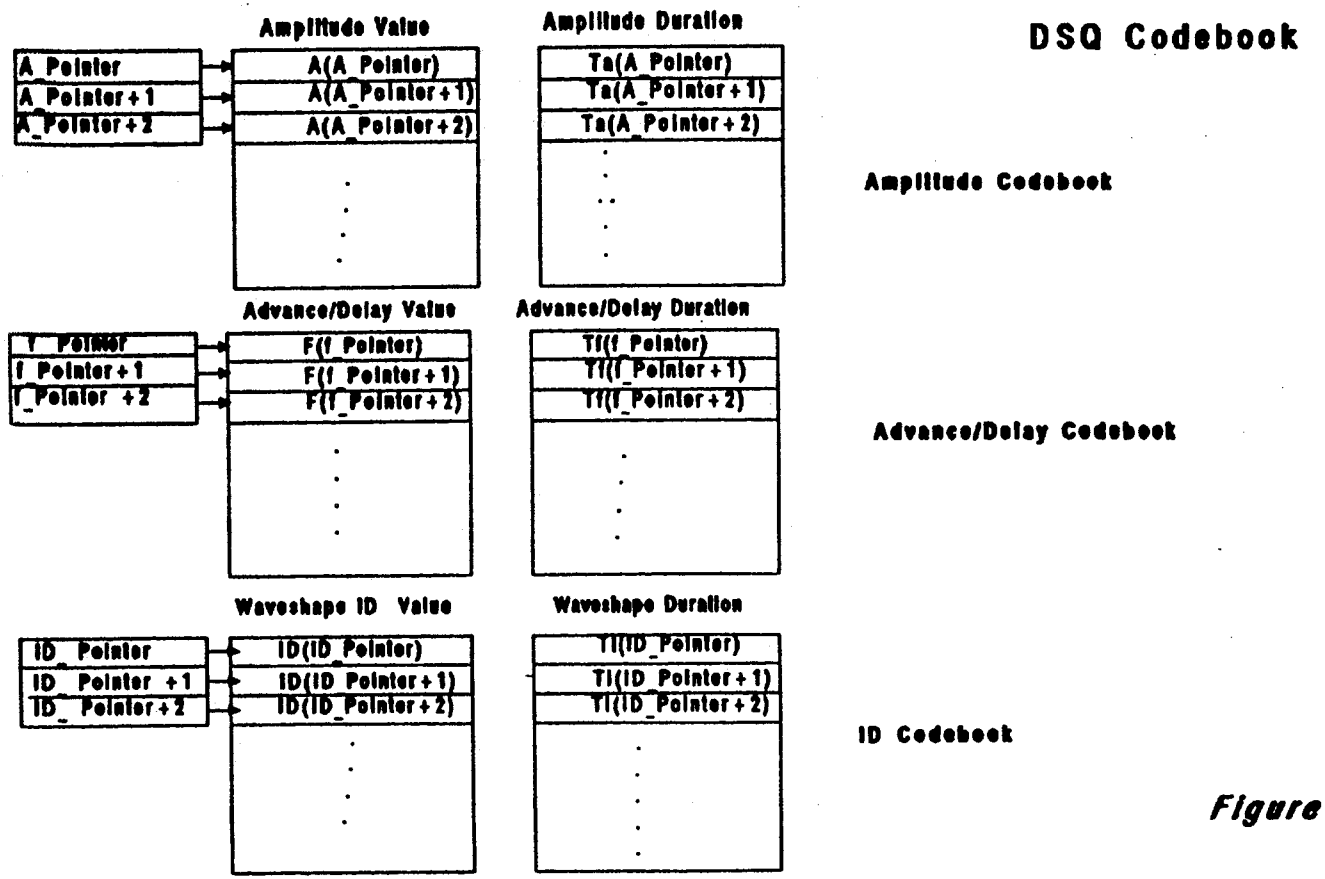
FIG. 10 is a block diagram of DSQ Codebook Memory organization.
Figure 13:
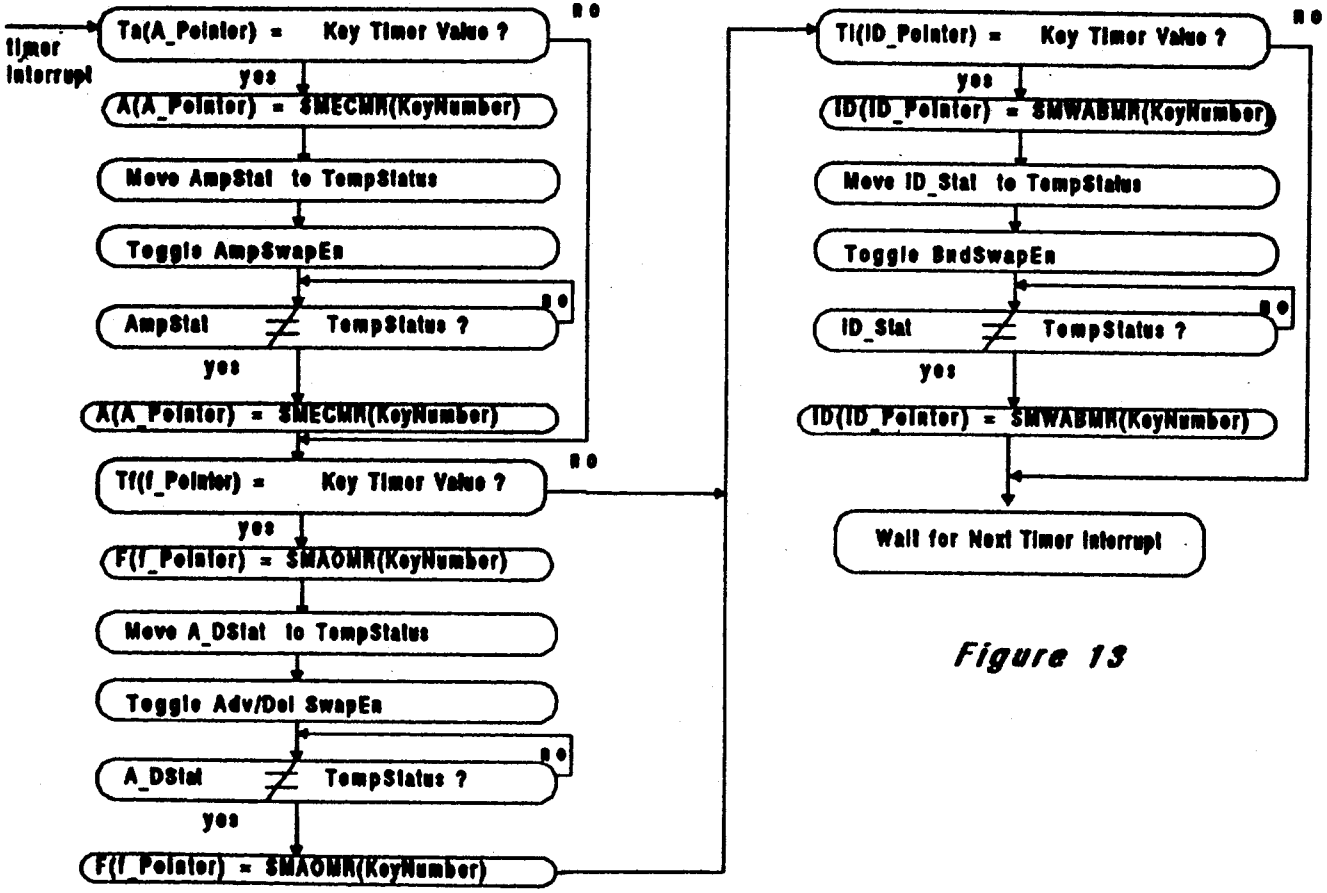
FIG. 13 is a flow chart diagram which illustrates the flow of operations performed by the System Computer.

The first action of the algorithm in FIG. 13 compares $T_k$ with the value stored in Key Timer 69. FIG. 10 illustrates that $T_k$ is the first entry of the Amplitude sequence $\{T_k\}$ for a DSQ Codebook entry in DSQ Codebook Memory 1. If $T_k$ equals the Key Timer 69 value, then the amplitude envelope value $A_k$ is transferred to SMECMR 79 by the presence of the $A_k$ data value on the System Data Bus and the low true assertion of the Amplitude Register File Write Enable signal as shown in FIG. 6.

SMECMR 79 is one dual register location in the Synchronized Manifold Envelope Coefficient Memory's Dual Amplitude Register File 47. The SMECMR 79 that $A_k$ is transferred to is one of the N dual registers assigned to Keynumber 66 by the System Computer's assignment algorithm. The System Computer's assignment algorithm may be one of many known tasks to register allocation algorithms which are common in the application programming or operating system programming art. After the Timer 60 interrupt service routine (illustrated by FIG. 13) transfers $A_k$ to the SMECMR 79, the System Computer's CPU enables a status buffer 53 by asserting AmpStatEn to read the AmpStat bit shown in FIG. 6. The AmpStat bit is used by the System Computer to determine the read/write status of the Dual Amplitude Register File 47. The system computer then stores the state of said bit by moving the AmpStat bit into a temporary status register (arbitrarily named TempStatus for explanation purposes) to a memory location in System RAM 64.

The next operation executed as illustrated by the flow diagram of FIG. 13 is Toggle AmpSwapEn which means that the System Computer 6 forces the AmpSwapEn signal (of FIG. 6) to go from a logic high state to a logic low state, then back to a logic high, logic level transition. This resets the FLIP FLOP 48 which sets the Q bit of the FLIP FLOP 48 to a logical low.

Next, the System Computer flow of operation is one of a continuous loop which polls the state of the AmpStat signal and compares it to the previously read and stored state of AmpStat(i.e., Is AmpStat not equal to TempStatus?). The Summation Computer 13 asserts the Swap Computed Address Register Files signal (of FIG. 6) to a low true state, then a high false state, thus generating a clock signal (high to low to high transition) at the out put of the OR gate 49. This clocks FLIP FLOP 48 and FLIP FLOP 51, which sets Q of FLIP FLOP 48 to a logic high and inhibits any further logic transitions at the output of the OR gate 49, and swaps the states of Q and Q* of FLIP FLOP 51, respectively. This in turn swaps the read and write registers in the Dual Amplitude Register File, and thus changes the state of the AmpStat signal.

The next operation as indicated in FIG. 13 is writing $A_k$ to the "other" dual register. Hence, the System computer generates a time variant amplitude data sequence of the form $\S A_k^+$ according to the form of EQ8 (i.e., 517 $A_k^+$ ) since successive values of $T_k$ may not equal each other. Then the index k is incremented by one in order to index the next entry in the $\S A_k$, $T_k^+$ Amplitude Codebook when the next Timer int occurs.

Since the Amplitude Register File Write Enable signal of FIG. 6 is a low true signal, the Write B signal at the output of the OR Gate 52 will be asserted low true when the Q* output of the D FLIP FLOP 51 is low and the Amplitude File Write Enable Signal is asserted low true. Hence, when the Q* output of 51 is low, the Dual Amplitude Register File 47 read/write configuration will be as illustrated by 83 of FIG. 11. Likewise, if the Q* bit of 51 is high, then the Dual Amplitude Register File 47 read/write configuration will be as illustrated by 82 of FIG. 11. Thus, the read/write status of Dual Amplitude Register File 47 is reflected by the state of the AmpStat signal.

Time Variant Advance/Delay Operator Sequence $\S dk^+$ Generation

Figure 5:
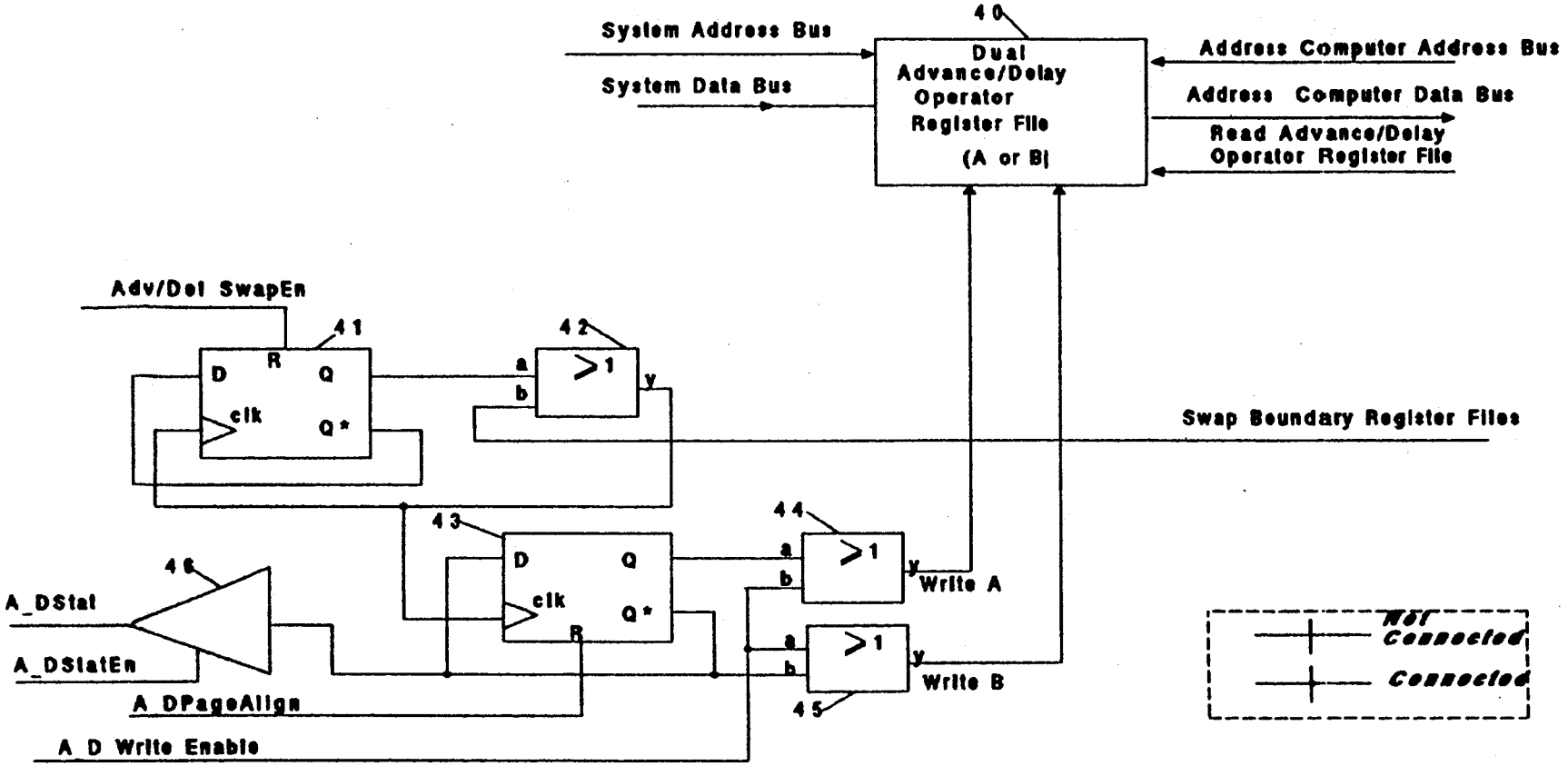
FIG. 5 is a schematic block diagram of the Synchronized Manifold Advance/Delay Operator Memory.

Next the action of the algorithm in FIG. 13 compares $T_j$ with the value stored in Key Timer 69. FIG. 10 illustrates that $T_j$ is the first entry in the memory allocated to the Advance/Delay Duration sequence $\S T_j^+$ for a DSQ Codebook entry in DSQ Codebook Memory 1. If $T_j$ equals the Key Timer 69 value, then the advance/delay operator value $d_j$ is transferred to SMAOMR 81 by the presence of the $d_j$ data value on the System Data Bus and the low true assertion of the A_D Write Enable signal as shown in FIG. 5. SMAOMR 81 is one dual register location in the Synchronized Manifold Advance/Delay Operator Memory's Dual Advance/Delay Operator Register File 40. The SMAOMR 81 that $d_j$ is transferred to is one of the N dual registers assigned to Keynumber 66 by the System Computer's assignment algorithm. The System Computer's assignment algorithm may be one of many known task to register allocation algorithms which are common in the application programming or operating system programming art.

After the Timer 60 interrupt service routine (illustrated by FIG. 13) transfers $d_j$ to the SMAOMR 81, the System Computer's CPU enables a status buffer 46 by asserting A_D StatEn to read the A_D Stat bit shown in FIG. 5. The A_D Stat bit is used by the System Computer to determine the read/write status of the Dual Advance/Delay Operator Register File 40, and stores the state of said bit by moving the A_D Stat bit into a temporary status register (arbitrarily named TempStatus for explanation purposes) to a memory location in System RAM 64.

The next operation executed as illustrated by the flow diagram of FIG. 13 is Toggle Adv/Del SwapEn which means that the System Computer 6 forces the Adv /Del SwapEn signal (of FIG. 5) to go from a logic high state to a logic low state, then back to a logic high logic level transition, thereby resetting the FLIP FLOP 41 which sets the Q bit of the FLIP FLOP 41 to a logical low.

Next, the System Computer flow of operation is one of a continuous loop which polls the state of the A_D Stat signal and compares it to the previously read and stored state of A_D Stat(i.e., Is A_D Stat not equal to TempStatus?). The Address Computer 11 asserts the Swap Boundary Register Files signal (of FIG. 5) to a low true state, then a high false state. This generates a clock sign al (high to low to high transition) at the output of the 0R gate 42, and clocks FLIP FLOP 41 and FLIP FLOP 43. This sets Q of FLIP FLOP 41 to a logic high and inhibits any further logic transitions at the output of the OR gate 42, and swaps the states of Q and Q* of FLIP FLOP 43, respectively, which swaps the read and write registers in the Dual Advance/Delay Operator Register File, and thus changes the state of the A_D Stat signal.

Figure 3:
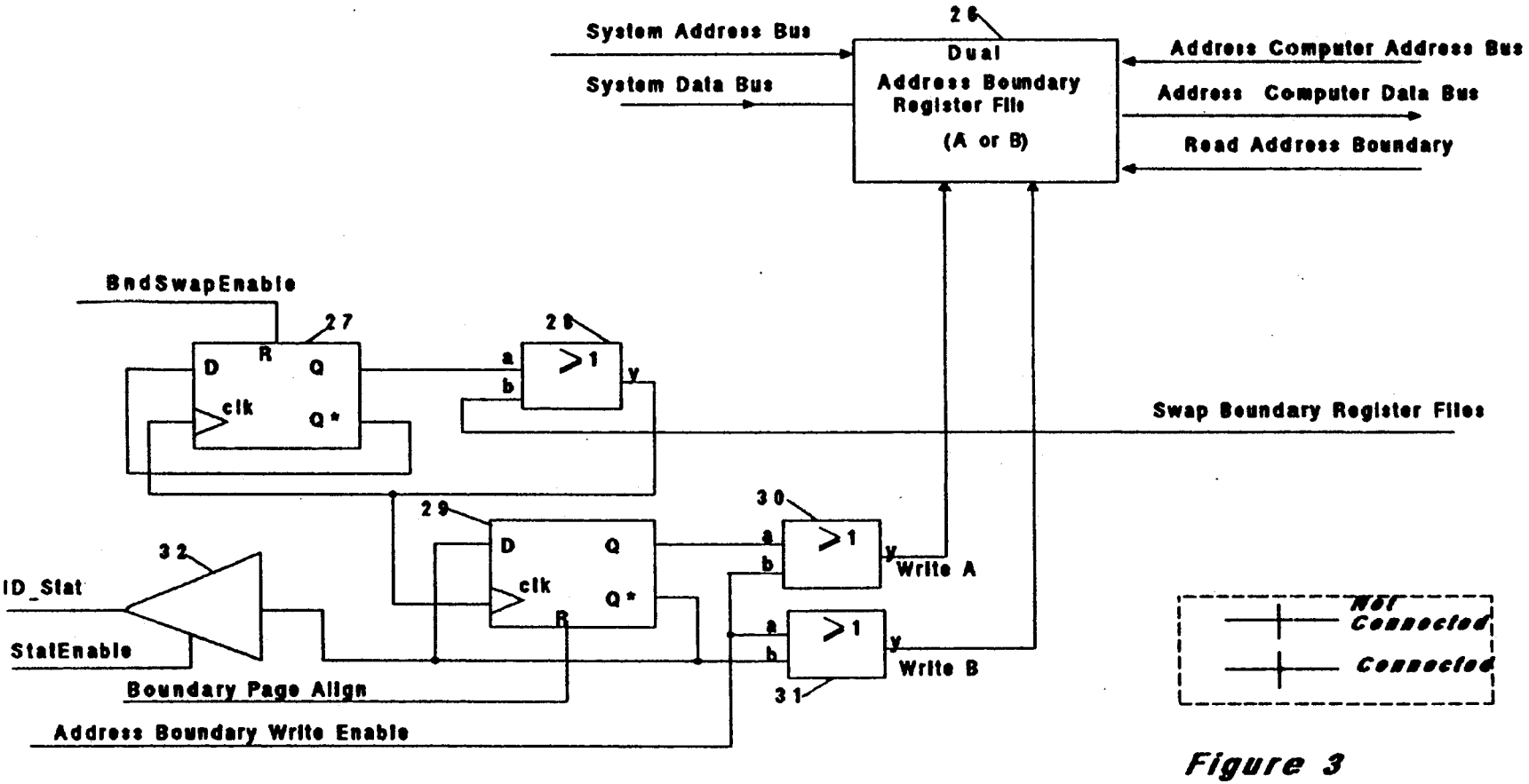
FIG. 3 is a schematic block diagram of the Synchronized Manifold Address Boundary Memory.
Figure 4:
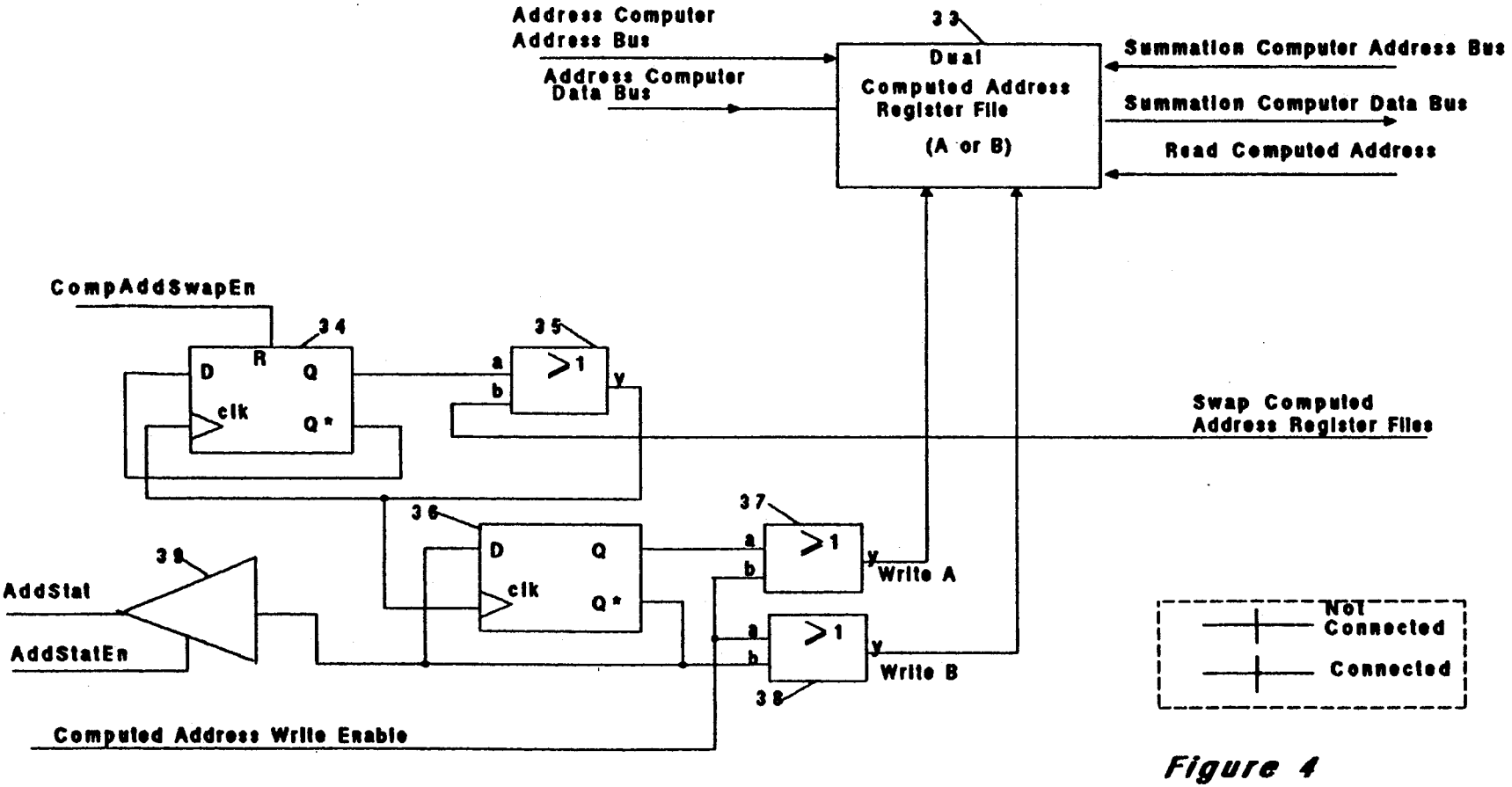
FIG. 4 is a schematic block diagram of the Synchronized Manifold Computed Data Point Address Memory.

The next operation as indicated in FIG. 13 is writing $d_j$ to the "other" dual register. Hence, the System computer generates a time variant amplitude data sequence of the form $\{d_j\}$ according to the form of EQ9 (i.e., $\{d_j\}$) since successive values of $T_j$ may not equal each other. Then the index j is incremented by one in order index the next entry in the $\{d_j,T_j\}$ Advance/Delay Codebook when the next Timer interrupt occurs. FIG. 3

Since the A_D Write Enable signal of FIG. 5 is a low true signal, the Write B signal at the output of the OR Gate 45 will be asserted low true when the Q* output of the D FLIP FLOP 43 is low and the A_D Write Enable Signal is asserted low true. Hence, when the Q* output of 43 is low, the Dual Advance/Del ay Operator Register File 40 read/write configuration will be as illustrated by 83 of FIG. 11. Likewise, if the Q* bit of 43 is high, then the Dual Advance/Delay Operator Register File 40 read/write configuration will be as illustrated by 82 of FIG. 11. Thus, the read/write status of Dual Advance/Delay Operator Register File 40 is reflected by the state of the A_D Stat signal.

Time Variant ID Vector Sequence $\{ID_i\}$ Generation

Finally, the action of the algorithm in FIG. 13 compares $T_{\{n\}i}$ with the value stored in Key Timer 69. FIG. 10 illustrates that $T_{\{n\}i}$ is the first entry in the memory allocated to the Waveshape Duration sequence $\{T_{\{n\}i}\}$ for a DSQ Codebook entry in DSQ Codebook Memory 1. If $T_{\{n\}i}$ equals the Key Timer 69 value, then the ID value $ID_i$ (it is implied that $ID_i$ is actually a data pair $B_i$ and $E_i$ according to EQ3b) is transferred to SMWABMR 80 by the presence of the $ID_i$ data value on the System Data Bus and the low true assertion of the Address Boundary Write Enable signal as shown in FIG. 3. SMWABMR 80 is one dual register location in the Synchronized Manifold Waveform Address Boundary Memory's Dual Address Boundary Register File 26. The SMWABMR 80 tht $ID_I$ is transferred to is one of the N dual registers assigned to Keynumber 66 by the System Computer's assignment algorithm. The System Computer's assignment algorithm may be one of many known task to register allocation algorithms which are common in the application programming or operating system programming art.

After the Timer 60 interrupt service routine (illustrated by FIG. 13) transfer $ID_I$ to the SMWABMR 80, the System Computer's CPU enables a status buffer 32 by asserting StatEnable to read the ID_Stat bit shown in FIG. 3. The ID_Stat bit is used by the System Computer to determine the read/write status of the Dual Address Boundary Register File 26, and stores the state of said bit by moving the ID_Stat bit into a temporary status register (arbitrarily named TempStatus for explanation purposes) to a memory location in System RAM 64.

The next operation executed as illustrated by the flow diagram of FIG. 13 is Toggle BndSwapEnable which means that the System Computer 6 forces the BndSwapEnable signal (of FIG. 3) to go from a logic high state to a logic low state, then back to a logic high logic level transition, thereby resetting the FLIP FLOP 27 which sets the Q bit of the FLIP FLOP 27 to a logical low.

Next, the System Computer flow of operation is one of a continuous loop which polls the state of the ID_Stat signal and compares it to the previously read and stored state of ID_Stat(i.e., Is ID_Stat not equal to TempStatus?). The Address Computer 11 asserts the Swap Boundary Register Files signal (of FIG. 3) to a low true state, then a high false state, thus generating a clock signal (high to low to high transition) at the output of the OR gate 28, and thereby clocking FLIP FLOP 27 and FLIP FLOP 29, which sets Q of FLIP FLOP 27 to a logic high and inhibits any further logic transitions at the output of the OR gate 28, and swaps the states of Q and Q* of FLIP FLOP 29, respectively, which swaps the read and write registers in the Dual Address Boundary Register File, and thus changes the state of the ID_Stat signal. The next operation as indicated in FIG. 13 is writing $ID_i$ to the "other" dual register. Hence, the System computer generates a time variant amplitude data sequence of the form $\{ID_i\}$ according to the form of EQ9 (i.e., $\{ID_i\}$) since successive values of $T_{\{n\}i}$ may not equal each other. Then the index i is incremented by one in order index the next entry in the $\{ID_i,T_{\{N\}i}\}$ ID Codebook when the next Timer interrupt occurs.

Since the Address Boundary Write Enable signal of FIG. 3 is a low true signal, the Write B signal at the output of the OR Gate 31 will be asserted low true when the Q* output of the D FLIP FLOP 29 is low and the Address Boundary Write Enable Signal is asserted low true. Hence, when the Q* output of 29 is low, the Dual Address Boundary Register File 26 read/write configuration will be as illustrated by 83 of FIG. 11. Likewise, if the Q* bit of 29 is high , then the Dual Address Boundary Register File 26 read/write configuration will be as illustrated by 82 of FIG. 11. Thus, the read/write status of Dual Address Boundary Register File 26 is reflected by the state of the ID_Stat signal.

Hence, if a plurality of key actuations interrupt the System Comput er 6 via the Serial Communication Interface 62, a plurality of sequences of the form $\S ID_i^+$, $\S d_j^+$, and $\S A_k^+$ will be generated and transferred to a plurality of registers in the Dual Address Boundary Register File 26, the Dual Advance/Delay Operator Register File 40, and the Dual Amplitude Register File 47, respectively.

Time Variant Address Sequence §$C_{nij}$+ Generation

The Address Computer 11 starts its computation cycle by reading the AddStat signal at the output of the buffer 39 which reflects the state of Q* of the Flip Flop 36 and hence the read/write configuration of the Dual Computed Address Register File 33, and stores the state in an internal register.

Next, the Address Computer 11 transfers a $B_i$,$E_i$ address boundary pair from Register n of the Dual Address Boundary Register File 26 to nth $B_i$ and $E_i$ locations internal to the Address Computer 11 (computers with internal registers are common to the integrated circuit computing art). The Address Computer 11 also transfers a $d_j$ from Register n of the Dual Advance/-Delay Operator Register File 40 to a nth $d_j$ location internal to the Address Computer 11 and computes $C_{nij}$ according to $$C_{nij}=B_i+(C_{(n-1)i}+d_j)MOD[(E_i+1)-B_i)] \quad \text{EQ5.}$$

for

§n+ $_i$=§1,2, . ,$N_i$+ , i=§1,2,.,I+ , j=§1,2,.,J+ , $B_i<E$, and Ω $E_i-B_i$ Ω =constant, for all i, where ti $C_{oi}=B_i$.

The computed $C_{nij}$ is then transferred to an nth $C_{nij}$ register internal to the Address Computer 11, and compared with its corresponding internally stored $E_i$, to check the condition $C_{nij}>E_i$. If the condition is false (i.e., $C_{nij}\leqq E_i$) then the Address Computer 11 transfers $C_{nij}$ to the Register n location of the Dual Computed Address Register File 33 by asserting the Computed Address Write Enable signal of FIG. 4 when the value $C_{nij}$ is on the Address Computer Data Bus and the address of the Register n location of the Dual Computed Address Register File 33 is on the Address Computer Address Bus. If $C_{nij}>E_i$ then the Address Computer subtracts $E_i$ from $C_{nij}$, then reads the nth $B_i$,$E_i$ address boundary pair from Register n of the Dual Address Boundary Register File 26 to nth $B_i$ and $E_i$ locations internal to the Address Computer 11. The Address Computer 11 then adds the $C_{nij}-E_i$ difference to the nth $B_i$, and transfers the result to the nth internal $C_{nij}$ register and the Register n location of the Dual Computed Address Register File 33 by asserting the Computed Address Write Enable signal of FIG. 4 when the value $C_{nij}$ is on the Address Computer Data Bus and the address of the Register n location of the Dual Computed Address Register File 33 is on the Address Computer Address Bus.

Therefore, a new $E_i$,$B_i$ boundary pair will be transferred to the Address Computer's internal $E_i$,$B_i$ register, only when $C_{nij}$ is greater than $E_i$ condition occurs, thereby ensuring the condition that $C_{nij}$ is always bounded by $B_i$ and $E_i$. This is a very important action which ensures that waveshapes will always be concatenated at the endpoints.

Figure 11:
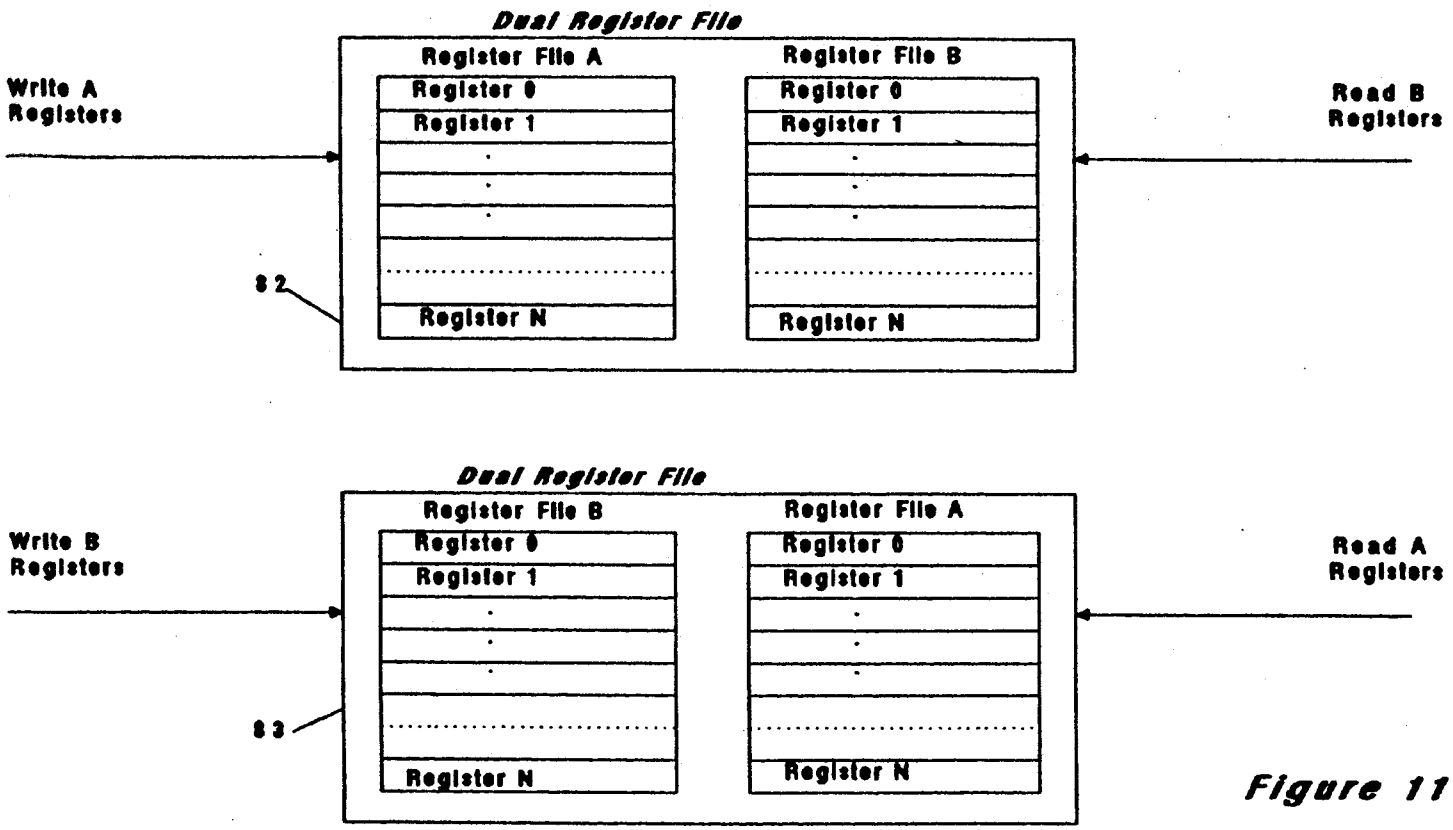
FIG. 11 is a block diagram of Dual Register File configurations.

At the end of the computation cycle, the Address Computer 11 toggles the CompAddSwapEn (of FIG. 4), then reads the AddStat state at the output of the buffer 39 and compares it to the state it stored in an internal register at the beginning of the computation cycle. When the state at the beginning of the computation cycle does not equal the state at the end of the computation cycle, the Address Computer 11 starts a new computation cycle. In this way, the Address Computer 11 ensures that the Dual Address read/write configuration (as illustrated in FIG. 11) has been swapped.

Waveshape Memory Organization

Figure 12:
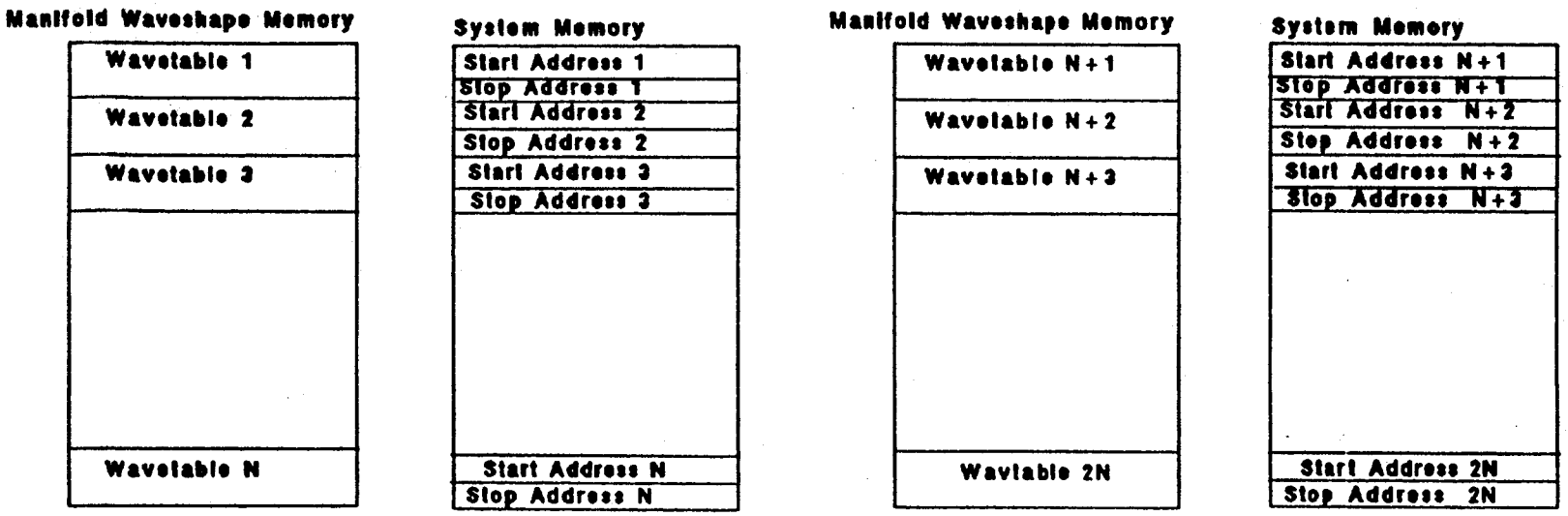
FIG. 12 is a block diagram of Manifold Waveshape Memory organization.

A plurality of digital wavetables representing a plurality of unique waveshapes can be stored in Virtual Waveform Memory 3. Virtual Waveform Memory 3 is a large memory (typically a hard disk) only directly accessible by the System Computer 6. A subset of the plurality of unique waveshapes stored in Virtual Waveform Memory 3 are transferred to Manifold Waveshape Memory 8 under System Computer 6 control by an initialization or configuration program. FIG. 12 illustrates a possible Manifold Memory 8 contents organization, as well as, a list of Start and Stop addresses (stored in System Memory (i.e., System RAM 64)) for every wavetable stored in Manifold Waveshape Memory 8.

The organization shown in FIG. 12 illustrates that for every wavetable entry in Manifold Waveshape Memory 8 there exists a start address and a stop address which correspond to a beginning point and an end point of a waveshape. Further, for illustrative purposes, it shall be assumed that every wavetable entry in Manifold Waveshape Memory 8 occupy the same memory block size of 1536 memory registers. Therefore, according to the organization shown in FIG. 12, Start Address 1 would be equal to the value of zero, and Stop Address 1 would equal 1535, Start Address 2 would equal 1536 and Stop Address 2 would equal 3071, and so forth. Note that by fixing the wavetable block size we have satisfied the restriction in EQ3b (i.e., $B_1<E_1$ and $|E_1-B_1|$=constant, for all i) for a DSQ Codebook, if the sequence $\{ID_i,T_{\{n\}i}\}$ of EQ10a contains ID values in the range of 1 to 2N. Manifold Waveshape Memory 8 is limited to 2N 1536 register data blocks, while many more than 2N wavetables will typically be stored in Virtual Waveform Memory 3. Wavetable 1 through Wavetable 2N stored in Manifold Waveshape Memory 8 are exactly the same lst through 2N wavetables stored in Virtual Waveform Memory. Data organization of this type is known in the computer memory architecture art as direct mapping.

If, in this example, the System Computer's Cache Tag Buffer 65 contained 2N entries of the waveshape numbers (1 through 2N), then each time the CPU 61 puts any ID value in the range of 1 through 2N on the System Bus, the Cache Tag Buffer 65 will flag the CPU that the Waveshape corresponding to the ID value is stored in Manifold Waveshape Memory 8.

Suppose that in this example, a waveshape ID value of a time variant ID sequence equalled the value 2N+1. The Cache Tag Buffer 65 would flag the CPU with a mismatch status flag, which would cause a CPU exception process to transfer the data block corresponding to ID=2N+1 from Virtual Waveform Memory 3 to either the first 1536 register block (illustrated as Wavetable 1 of FIG. 12) location of Manifold Waveshape Memory A 19 or Manifold Waveshape Memory B 24(illustrated as Wavetable N+1 of FIG. 12).

Figure 2:
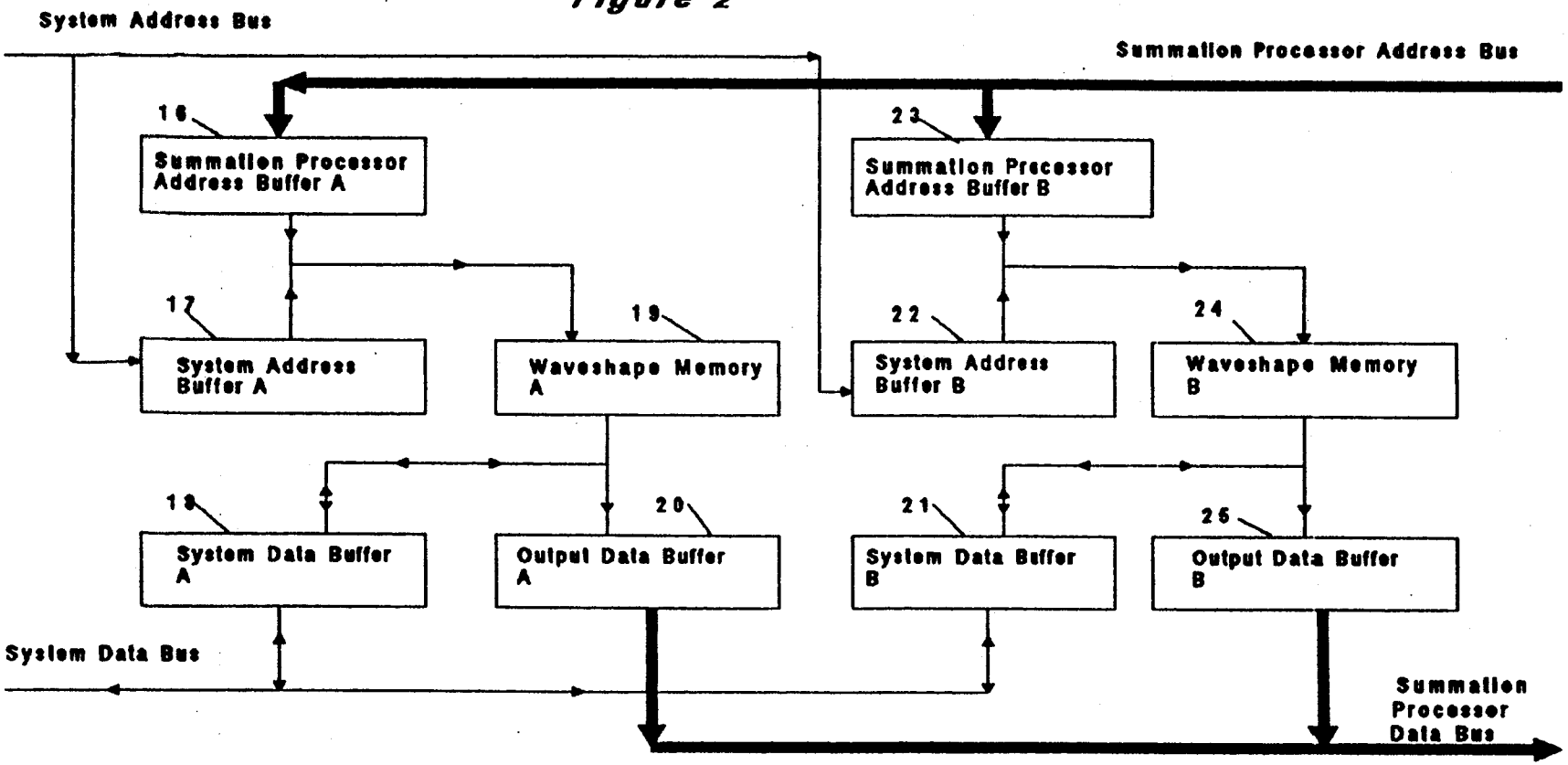
FIG. 2 is a schematic block diagram of the Manifold Waveshape Memory.

The block data transfer and ID comparison action is referred to as two level direct mapped data caching, and it is well known and commonly implemented in the computer architecture and programming art. However, what is not common in computer architecture prior art is a data cache with the port architecture illustrated in FIG. 2. The Manifold Architecture illustrated in FIG. 2 is implemented such that 2N data blocks are contiguously addressable by the Summation Computer 13 via the Summation Processor Address Bus (assuming N data blocks of memory for Waveshape Memory A and N data blocks of Memory for Waveshape Memory B), while only N data blocks are addressable by the System Computer 6 via the System Address Bus The state of the most significant address bit of the Summation Processor Address Bus logically determines bus activity and arbitration of the bus buffers illustrated in FIG. 2 in the following manner.

If the state of the most significant bit of the Summation Processor Address Bus is logical low, then the Summation Processor Address Buffer A 16 and Output Data Buffer A 20 will be enabled. Waveshape Memory A 19 will be in a read memory mode (i.e., the Summation Computer 13 is reading a data value from Waveshape Memory A 19), Summation Processor Address Buffer B 23, and Output Data Buffer B 25 will be in a high impedance state. The System Address Buffer A 17 and System Data Buffer A 18 will be inhibited and in a high impedance state. The System Address Buffer B 22 and System Data Buffer B 21 and Waveshape Memory B 24 will be uninhibited.

Since, System Address Buffer B 22, and System Data Buffer B 21, and Waveshape Memory B 24 will be uninhibited when the most significant bit of the Summation Processor Address Bus is low, the System Processor 6 is free to access (read or write data) Waveshape Memory B 24. Thus, the System Computer 6 can transfer wavetable data blocks from Virtual Waveform Memory 3 to Waveshape Memory B 24 while the Summation Computer 13 is accessing Waveshape Memory A 19.

If the state of the most significant bit of the Summation Processor Address Bus is logical high, then the Summation Processor Address Buffer B 23 and Out put Data Buffer B 25 will be enabled. Waveshape Memory B 24 will be in a read memory mode (i.e., the Summation Computer 13 is reading a data value from Wave shape Memory B 24). Summation Processor Address Buffer A 16, and Output Data Buffer A 20 will be in a high impedance state. System Address Buffer B 22, and System Data Buffer B 21 will be inhibited and in a high impedance state, and the System Address Buffer A 17 and System Data Buffer A 18 and Waveshape Memory A 19 will be uninhibited.

Since, System Address Buffer A 17, and System Data Buffer A 18, and Waveshape Memory A 19 will be uninhibited when the most significant bit of the Summation Processor Address Bus is low, the System Processor 6 is free to access (read or write data) Waveshape Memory A 19. Thus, the System Computer 6 can transfer wavetable data blocks from Virtual Waveform Memory 3 to Waveshape Memory A 19 while the Summation Computer 13 is accessing Waveshape Memory B 24.

Multi Channel Time Variant Waveform Reconstruction

The Summation Computer 13 starts a computation cycle by reading the data value stored in the first register location in Dual Computed Address Register File 33,(which is a $C_{nij}$). It then uses the data value as an address to transfer a waveshape data value (which is an $X_{nij}$) stored in Manifold Waveshape Memory 8 to an internal register in the Summation Computer 13. Next, the Summation Computer 13 reads the data value in first register in the Dual Amplitude Register File 47 (which is an $A_k$) and multiplies the data value by the waveshape data value ($X_{nij}$) previously stored in said internal register. Hence the Summation Computer 13 performs the mathematical operation $A_k*(X_{nij})$ (i.e., $A_k$ multiplied by $X_{nij}$, and accumulates the result.

In a like fashion, the Summation Computer 13 reads the data value stored the second register location in Dual Computed Address Register File 33, (which is a $C_{nij}$), then uses the data value as an address to transfer a waveshape data value (which is an $X_{nij}$) stored in Manifold Waveshape Memory 8 to an internal register in the Summation Computer 13.

Next, the Summation Computer 13 reads the data value in second register in the Dual Amplitude Register File 47 (which is an $A_k$) and multiplies the data value by the waveshape data value ($X_{nij}$) previously stored in the internal register. In doing so, the Summation Computer 13 performs the mathematical operation $A_k*(X_{nij})$ (i.e., $A_k$ multiplied by $X_{nij}$, and accumulates the result. Hence, the Summation Computer 13 multiplies an $A_k$ by an $X_{nij}$ corresponding to a $C_{nij}$ for each register in Dual Amplitude Register File 47 and Dual Computed Address Register File 33, respectively, and sums the plurality of $A_k*X_{nij}$. It then outputs the result to the Digital to Analog Converter 14 which drives the Sound System 15. Subsequently, the Swap Computed Address Register Files signal is toggled which maps new $C_{nij}$ and $A_k$ in the into Summation Processor 13 memory map. The Summation Processor's computation cycle then start over.

Hence, after many Summation Processor 13 computation cycles occur, a plurality of time variant sequences of the form of EQ7 given by $$\{\{X_{cnjk}\}_l\} = \{\{A_k(X_{cnj})\}_1\}$$

can be generated.

What is claimed is:

1. A time variant tone generating device; comprising:

virtual memory means for storing unique waveform data, pitch deviation data, amplitude envelope data, and waveform address boundary data;

first processing means for transferring said pitch deviation data and said waveform address boundary data from said virtual memory means to a second processing means, for transferring said unique waveform data from said virtual memory means to a first memory means accessible by said first processing means and a thrid processing means, and for transferring amplitude envelope data to said thrid processig means;

said second processing means including means for determining waveform data points in said first memory means to be accessed by said third processing means based on said waveform address boundary data and said pitch deviation data;

said third processing means including means for accessing said waveform data points in said first memory means, for scaling said waveform data points based on said amplitude envelope data, and for summing scaled waveform data points; and a digital to analog converter for converting said summed waveform data points to a time variant output signal.

2. The device of claim 1, wherein said first memory means is a dual port random access memory device.

3. The device of claim 1, wherein said second processing means provides said waveform data points to said third processing means via a second memory means.

4. The device of claim 3, wherein said second memory means is a dual port random access memory device.

* * * * *